United States Patent [19]

Harris

[11] Patent Number: 4,757,966

[45] Date of Patent: Jul. 19, 1988

[54] BAG HOLDER

[76] Inventor: John A. Harris, 111 Old Mill Road, Winnipeg, Manitoba, Canada, R3J 3H1

[21] Appl. No.: 903,459

[22] Filed: Sep. 4, 1986

[30] Foreign Application Priority Data

Apr. 25, 1986 [CA] Canada ..... 507677

[51] Int. Cl.[4] ..... B65B 67/12

[52] U.S. Cl. ..... 248/97; 248/101; 141/313; 141/390

[58] Field of Search ..... 248/95–101; 141/10, 68, 114, 313–317, 390; 294/1.1; 403/297, 292

[56] References Cited

U.S. PATENT DOCUMENTS

| | | | |
|---|---|---|---|
| 1,005,956 | 10/1911 | Gibbins | 248/100 |
| 2,525,703 | 10/1950 | McGirr | 403/297 X |
| 3,866,872 | 2/1975 | Burgess | 248/188.7 |
| 3,916,962 | 11/1975 | Stolt | 248/101 |
| 4,017,092 | 4/1977 | Boomer | 248/98 |
| 4,143,796 | 3/1979 | Williamson | 248/95 |
| 4,157,801 | 6/1979 | Elmer | 248/97 |
| 4,482,116 | 11/1984 | Vadnais | 248/99 |
| 4,548,372 | 10/1985 | Lutzker | 248/99 |
| 4,561,480 | 12/1985 | Underwood | 294/1.1 |

FOREIGN PATENT DOCUMENTS

| | | | |
|---|---|---|---|
| 60986 | 9/1913 | Austria | 248/99 |
| 12835 | 1/1910 | Denmark | 248/99 |

*Primary Examiner*—Alvin C. Chin-Shue

*Attorney, Agent, or Firm*—Stanley G. Ade; Adrian D. Battison; Murray E. Thrift

[57] ABSTRACT

Plastic bags used for grass clippings, leaves and other types of garden refuse are difficult to hold open during the filling thereof and although hoop assemblies are known which are wall or ground supported, these are not portable and the debris has to be picked up and transported to the bag and elevated to the open top thereof which may be some three feet from the ground or supporting surface. The present device is a hand-held hoop of resilient plastic tubing with resilient clamps spaced around the hoop to hold the upper end of a plastic bag attached to the hoop. This permits the bag to be held horizontally to the ground thus facilitating the placement of garden debris and the like to be scooped or urged into the bag. A mesh holder for the bag may be used if desired to support the load of the bag and prevent inadvertent displacement thereof from the hoop.

13 Claims, 2 Drawing Sheets

BAG HOLDER

BACKGROUND OF THE INVENTION

This invention relates to new and useful improvements in holders for bags such as plastic bags normally used for the collection of debris such as grass clipings, leaves and the like in a garden or other area. Such bags are also used in workshops or other locations where unwanted debris is collected and accumulated until the plastic bag is substantially full.

Various forms of supports are known for such plastic bags and these usually support the plastic bag in a substantially vertical position with the open top being situated above the supporting surface a distance at least equal to the height of the plastic bag. This means that when collecting material from the ground or floor, it has to be transported to the bag and then elevated approximately three feet or more so that it can be deposited within the bag.

When used outdoors, the hot sun weakens the plastic and often causes same to rip or tear particularly when the base of the bag is clear of the ground or when too much material has been placed in the bag to cause strain to occur on the walls thereof.

The present invention overcomes all of these difficulties by providing a holder for the bag which can be hand-held parallel to the ground or supporting surface or, alternatively, can be supported in a stand in which the open end can be successively raised from a lower position to the fully extended position.

In accordance with the invention there is provided a holder for plastic bags which includes an open upper end defined by surrounding wall portion, said holder comprising a substantially circular hoop formed from a length of flexible resilient plastic tubing having some inherent self-supporting rigidity, means to join the ends of said length of flexible tubing to define said hoop, said surrounding wall portion at the open upper end of the associated plastic bag, engaging through said hoop and folding thereover and clamp means detachably engaging over said portion of said bag folding over said hoop to thereby clamp same to said hoop.

Another advantage of the invention is to provide a mesh enclosure which supports the bag during loading and prevents undue strain from occurring to the walls of the plastic bag.

A still further advantage of the invention is to provide a stand for the bag and holder so that, if desired, the bag and enclosure can be held vertically in a conventional manner.

A still further advantage of the invention is to provide a device of the character within described which is simple in construction, economical in manufacture and otherwise well suited to the purpose for which it is designed.

With the foregoing in view, and other advantages as will become apparent to those skilled in the art to which this invention relates as this specification proceeds, the invention is herein described by reference to the accompanying drawings forming a part hereof, which includes a description of the best mode known to the applicant and of the preferred typical embodiment of the principles of the present invention, in which:

DESCRIPTION OF THE DRAWINGS

In the drawings like characters of reference indicate corresponding parts in the different figures.

DETAILED DESCRIPTION

Figure 3:
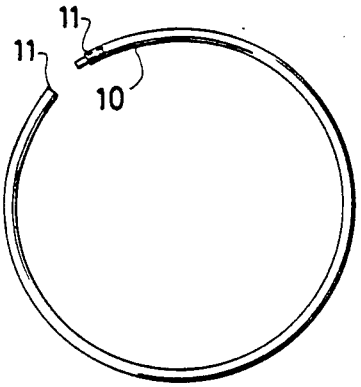
FIG. 3 is a top plan view of the hoop showing the junction of the ends thereof.

Proceeding therefore to describe the invention in detail reference should first be made to FIG. 3 which shows a hoop 10 formed from a length of resilient flexible plastic tubing which can be formed into a loop without kinking occurring and which has sufficient inherent rigidity to maintain the hoop configuration when the ends 11 are secured together.

Figure 4:
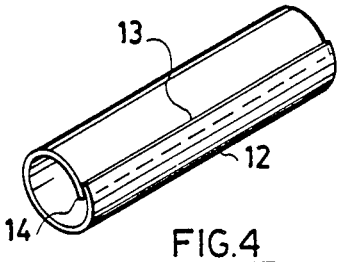
FIG. 4 is a isometric view of the hoop junction member.

FIG. 4 shows the preferred embodiment of a junction used to hold the ends in the adjacent abutting position, said means taking the form of a relatively short length of plastic tubing 12 similar to the tubing used to form the hoop 10. This length of tubing is slit longitudinally to form two longitudinal edges 13 and 14 and these edges are over lapped one with the other thus temporarily reducing the effective diameter of the length of tubing 12 against the normal resiliency thereof. This permits one end of the length of tubing 12 to be inserted within one end 11 of the hoop 10 whereupon the other end of the hoop 11 may be engaged over the other end of the short length of tubing 12 so that the two ends 11 abut one another. Release of the pressure upon the length of tubing 12 permits the inherent resiliency thereof to expand this length of tube outwardly thus frictionally holding the two ends together and forming the completed hoop. Alternatively of course these ends may be cemented within the ends 11 if desired.

In the preferred embodiment, a conventional platic bag 15 is utilized. This includes an upper open end defined by an upper wall portion 16 and this upper wall portion is engaged upwardly through the hoop and the free upper edge 17 is then folded over the hoop and downwardly as clearly shown in FIG. 1.

Figure 1:
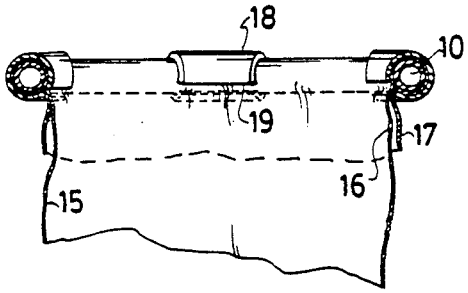
FIG. 1 is a fragmentary cross-sectional view of the holder with a bag supported therefrom.
Figure 2:
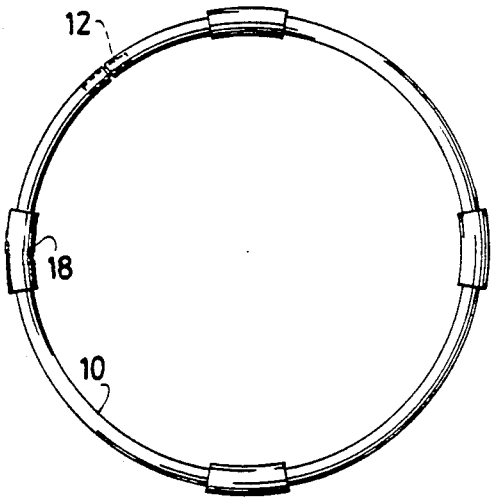
FIG. 2 is a top plan view of the holder assembly per se.
Figure 5:
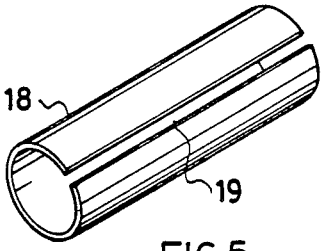
FIG. 5 is an isometric view of one of the clamps.

Detachable clamping means are provided and are indicated by reference character 18 and shown in FIG. 5. These are also relatively short lengths of flexible plastic tubing similar to the tubing used for the hoop 10. These short lengths are slit lengthwise as indicated by reference character 19 so that they can be expanded in diameter so that they will engage over the hoop 10 and the portion of the plastic bag engaged thereover. The inherent resiliency of these lengths of tubing 18 cause them to move towards the closed position thus applying a clamping action to the bag over the hoop as shown in FIG. 1.

In the drawings, three such clamps 18 are shown but of course more can be used depending upon the diameter of the hoop 10 and the associated plastic bag 15.

Figure 6:
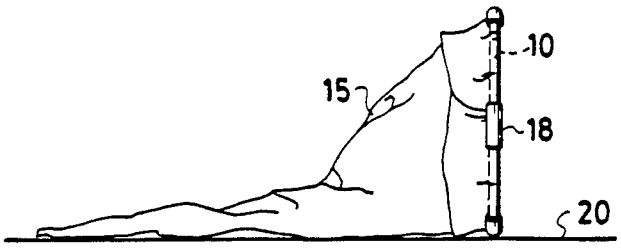
FIG. 6 shows the device in the position for scooping debris from the ground into the bag through the hoop.

The inherent rigidity of the hoop, when formed, permits the bag to be held by the hand engaging the hoop so that it is in a position such as that shown in FIG. 6 whereby the hoop is perpendicular to the ground or supporting surface 20. This facilitates the scooping of leaves, grass clippings and other debris into the bag without the necessity of having to lift or elevate the material to reach the open upper end of a bag normally supported above ground level.

Figure 8:
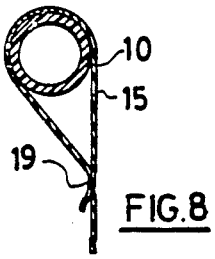
FIG. 8 is an enlarged fragmentary cross-sectional view showing an alternative method of securing the bag to the hoop.
Figure 9:
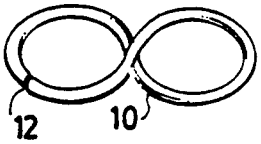
FIG. 9 is a schematic view showing the hoop twisted into a FIG. 8 configuration for assisting in the tying off of the bag.

When substantially full, a twist of the hoop will cause it to temporarily take up a FIG. 8 position shown in FIG. 9 which twists the bag top and permits easy closing of the bag by means of a flexible tie or the like. The hoop is then allowed to return to the normal circular configuration, the clamps 18 may be removed and the tied or closed bag removed from the hoop.

FIG. 8 shows an alternative formation for the bag 15 in which the upper wall portion is folded over and heat sealed as at 19 thus forming a sleeve at the upper end through which the hoop 10 may be fed prior to the ends of the hoop being joined. In this connection a gap must be left in the sleeve to enable the end of the hoop to be fed into the sleeve and the two ends of the hoop joined once the sleeve has been threaded onto the hoop.

Figure 7:
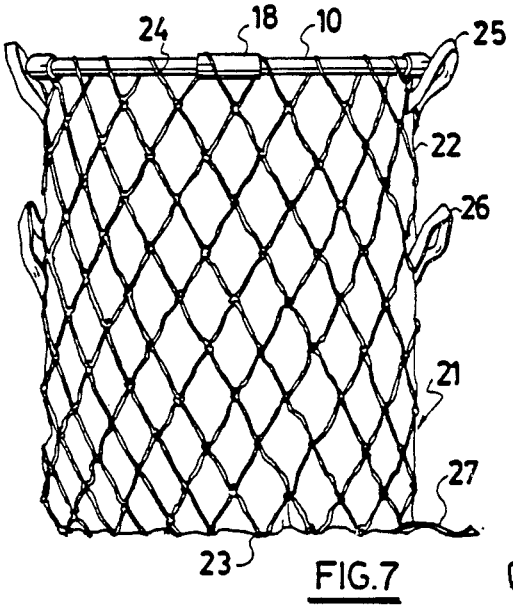
FIG. 7 is a front elevation of the hoop with an enclosure secured thereto.

FIG. 7 shows a further embodiment which includes an enclosure collectively designated 21 to support the plastic bag particularly when partially or substantially full.

It is well known that the plastic used for such bags weakens under relatively high temperatures which may be caused by hot sun and the enclosure 21 gives support to prevent inadvertent damage occurring to the bag due to the weight of the material therein.

It is preferably formed of a cylinder of netting 22 having a closed base 23 and is threaded by the upper loops 24, onto the hoop prior to the plastic bag being engaged over the hoop and clamped by means of clamps 18.

The dimensions and configuration of the enclosure are similar to those of the plastic bag and gives support to the bag when in use.

Pairs of handles 25 and 26 may be provided with the upper most pair 25 being adjacent the upper end of the closure and the lower most pair 26 being approximately halfway down the enclosure. This permits transportation of the bag and enclosure from one location to the other with the opposed handles 25 or 26 being used depending upon circumstances.

In order to facilitate removal of the loaded plastic bag from the enclosure, a foot engaging flexible member 27 is secured to the base and extends upwardly therefrom. This may take the form of a tape, rope or other suitable material and can be engaged by the foot to hold the base anchored firmly to the supporting surface while the bag is being pulled from the enclosure and through the hoop.

Figure 10:
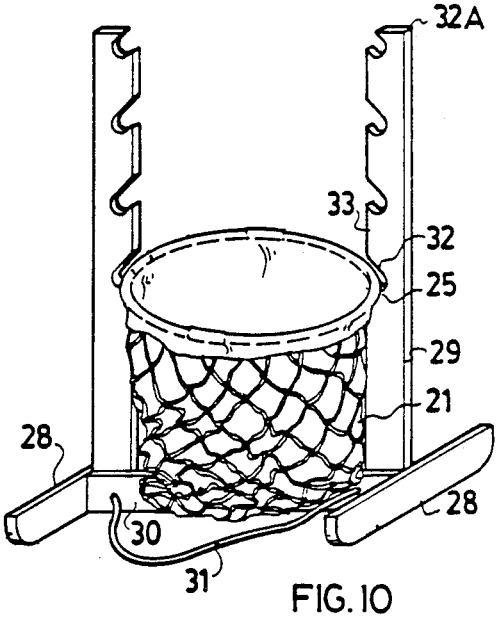
FIG. 10 is an isometric view of the bag holder.

While the hoop support is designed primarily for hand held use such as that shown in FIG. 6, nevertheless it may be supported vertically for intermittent placement of material therein such as in a workshop, garage or the like and such a holder is shown in FIG. 10. It includes base members 28 in the form of skids with a pair of spaced and parallel upright standards 29 extending upwardly therefrom and braced by lower cross member 30. Pull ropes 31 may be secured to this cross member 30 to move the support from one location to the other.

One of the pairs of the hands 25 or 26 are used to support the bag and enclosure within the support by engaging these opposed handles into any one of a plurality of matching hooks or notches 32 formed on the inner sides 33 of the standards 29. For example, when the bag is empty, the bag and enclosure may be supported in the lower most notches 32. As the bag is filled, to this level, it may be elevated to subsequent upper notches until it is fully extended when engaged in the upper most notches 32A so that the upper open end of the bag is at the lowest possible position for loading at all times.

The holder, enclosure and support may be sold separately or as a kit thus providing a plastic bag support which although designed primarily for hand held use, nevertheless can be readily adapted for use as a vertically supported device with the upper end held open by the hoop 10.

Since various modifications can be made in my invention as hereinabove described, and many apparently widely different embodiments of same made within the spirit and scope of the claims without departing from such spirit and scope, it is intended that all matter contained in the accompanying specification shall be interpreted as illustrative only and not in a limiting sense.

I claim:

1. The combination of a hand held holder and a plastic garbage bag, said bag including an open upper end defined by a surrounding wall portion, said holder comprising a substantially circular hoop formed from a length of flexible resilient plastic tubing having some inherent self-supporting rigidity, means to join the ends of said length of flexible tubing to define said hoop, said surrounding wall portion at the open upper end of the associated plastic bag, engaging through said hoop and folding thereover and clamp means detachably engaging over said portion of said bag folding over said hoop to thereby clamp same to same hoop, said clamp means comprising a plurality of relatively short, independent, unconnected lengths of flexible plastic tubing, each being slit lengthwise to form a resilient, substantially closed C-shaped clamp, and a bag enclosure attached to said hoop and depending therefrom, at least the upper end portion of said enclosure being formed from open meshed material, said enclosure being substantially similar in configuration and dimensions to the associated plastic bag, said hoop being threaded through the upper apertures of said open mesh material prior to the end of said hoop being joined together, and prior to engagement of said hoop open upper end of said plastic bag with said hoop said means to join the ends of said hoop together, comprising a further relatively short length of flexible plastic tubing similar in dimensions to the tubing used for said hoop, said further length of flexible plastic tubing being slit lengthwise to be reduced in diameter against the resiliency thereof, by overlapping the lengthwise edges of said further tubing to engage same with the adjacent ends of said hoop, the resiliency of said further tubing frictionally engaging the outer surface of said further tubing with the inner wall of said hoop.

2. The holder according to claim 1 which includes a stand for selectivity supporting said enclosure in a substantially vertical position in a plurality of locations above a supporting surface, said stand including a base, a pair of spaced and parallel upright standards extending upwardly from said base and at least one pair of enclosure engaging hooks one on each said standards, at substantially the same height from said base.

3. The holder according to claim 1 which includes a foot engaging flexible member secured by one end thereof to adjacent the base of said enclosure and extending beyond said enclosure for selectively anchoring the enclosure to a supporting surface when removing the plastic bag therefrom.

4. The holder according to claim 3 which includes a stand for selectivity supporting said enclosure in a substantially vertical position in a plurality of locations above the supporting surface, said stand including a base, a pair of spaced and parallel upright standards extending upwardly from said base and at least one pair of enclosure engaging hooks one on each said standards, at substantially the same height from said base.

5. The holder according to claim 1 which includes at least one pair of opposed handles situated adjacent the upper end of said bag enclosure.

6. The holder according to claim 5 which includes a stand for selectivity supporting said enclosure and a substantially vertical position in a plurality of locations above a supporting surface, said stand including a base, a pair of spaced and parallel upright standards extending upwardly from said base and at least one pair of enclosure engaging hooks one on each said standards, at substantially the same height from said base and engageable by said handles.

7. The holder according to claim 5 which includes a foot engaging flexible member secured by one end thereof to adjacent the base of said enclosure and extending beyond said enclosure for slectively anchoring the enclosure to the supporting surface when removing a plastic bag therefrom.

8. The holder according to claim 7 which includes a stand for selectivity supporting said enclosure and a substantially vertical position in a plurality of locations above the supporting surface, said stand including a base, a pair of spaced and parallel upright standards extending upwardly from said base and at least one pair of enclosure engaging hooks one on each said standards, at substantially the same height from said base and engageable by said handles.

9. The holder according to claim 5 which includes a second pair of opposed handles situated approximately halfway down the length of said enclosure.

10. The holder according to claim 9 which includes a foot engaging flexible member secured by one end thereof to adjacent the base of said enclosure and extending beyond said enclosure for selectively anchoring the enclosure to a supporting surface when removing the plastic bag therefrom.

11. The holder according to claim 9 which includes a stand for selectivity supporting said enclosure and a substantially vertical position in a plurality of locations above a supporting surface, said stand including a base, a pair of spaced and parallel upright standards extending upwardly from said base and at least one pair of enclosure engaging hooks one on each said standards, at substantially the same height from said base and engageable by said handles.

12. The combination of a hand held holder and a plastic garbage bag, said bag including an open upper end defined by a surrounding wall portion, said holder comprising a substantially circular hoop formed from a length of flexible resilient plastic tubing having some inherent self-supporting rigidity, means to join the ends of said length of flexible tubing to define said hoop, said surrounding wall portion at the open upper end of the associated plastic bag, enagaging through said hoop and folding thereover and clamp means detachably engaging over said portion of said bag folding over said hoop to thereby clamp same to said hoop, and means to join the ends of said hoop together, said means comprising a relatively short length of flexible plastic tubing similar in dimensions to the tubing used for said hoop, said short length of flexible plastic tubing being slit lengthwise to permit the length of said tubing to be reduced in diameter against the resiliency thereof, by overlapping the lengthwise edges of said short tubing, to engage same with the adjacent ends of said hoop, the resiliency of said short tubing frictionally engaging the outer surface of said short tubing with the inner wall of said hoop.

13. The combination according to claim 12 in which said clamp means comprises a plurality of relatively short, independent, unconnected lengths of flexible plastic tubing, each being split lengthwise to form a resilient, substantially closed, c-chaped clamp.

* * * * *